United States Patent [19]

Thompson, Jr.

[11] 4,105,280

[45] Aug. 8, 1978

[54] HIGH CURRENT DENSITY ELECTRICAL CONTACT

[76] Inventor: Lloyd E. Thompson, Jr., 158 Clark Rd., Rye, N.H. 03870

[21] Appl. No.: 782,820

[22] Filed: Mar. 30, 1977

Related U.S. Application Data

[63] Continuation of Ser. No. 680,624, Apr. 26, 1976, abandoned.

[51] Int. Cl.[2] ..... H01R 7/06

[52] U.S. Cl. ..... 339/273 S

[58] Field of Search ..... 339/273 R, 273 F, 273 S

[56] References Cited

U.S. PATENT DOCUMENTS

| | | | |
|---|---|---|---|
| 2,014,056 | 10/1935 | Noorden | 339/273 S UX |
| 2,966,653 | 12/1960 | Jugle | 339/273 S X |
| 3,071,750 | 1/1963 | Heselwood | 339/273 F X |
| 3,904,814 | 9/1975 | Dawson et al. | 339/273 R X |

FOREIGN PATENT DOCUMENTS

| | | | |
|---|---|---|---|
| 931,064 | 7/1963 | United Kingdom | 339/273 R |

*Primary Examiner*—Howard N. Goldberg

*Attorney, Agent, or Firm*—R. S. Sciascia; L. I. Shrago

[57] ABSTRACT

The disclosure concerns an electrical contact for conducting high current densities in a minimum of space and with improved connection between the contact and the socket. The contact includes a split, internally tapered circular sleeve which is mounted in spring-loaded engagement in a socket. A tapered contact pin conforms to the split sleeve and when inserted causes the sleeve to be wedged between the pin and the socket. The compression spring generates large contact pressures in a relatively short length of connector travel, thus enabling the mechanical advantage of the coupling mechanism to accomplish connector engagement with minimal operator effort.

9 Claims, 9 Drawing Figures

HIGH CURRENT DENSITY ELECTRICAL CONTACT

This is a continuation of application Ser. No. 680,624 filed 26 Apr. 1976, now abandoned.

The invention described herein may be manufactured and used by or for the Government of the United States of America for governmental purposes without the payment of any royalties thereon or therefor.

The present invention concerns electrical contacts and, more particularly, a contact for providing high current density conduction in a minimum space and wherein the mating components become fully engaged at substantially the moment of contact between them.

Conventional slotted contacts for conducting large currents include concentrically mated pins and sockets which decrease in contact efficiency as the mating cycles increase. The amount of surface contact between pin and socket is uncertain as it is extremely difficult to maintain the pins within close tolerances, among other deficencies of this type of contact. In other high current density connectors, considerable force is required from initial insertion of the pin in the receptacle socket until final engagement of the components is completed. To reduce this force and permit proper assembly clearances are machined in the parts with the result, however, that contact is made only at the entrances of the socket and is essentially along a circle or narrow band of mating parts. The present invention overcomes the deficiencies of prior art contacts by providing maximum conduction through utilizing tapering pins and socket pieces which become fully engaged at substantially the moment of contact.

Accordingly, it is an object of the present invention to provide an electrical contact which is capable of conducting high current densities while being compact, easily serviceable, and resistant to the normal shipboard or industrial environment of vibration and mechanical shock.

Another object of the invention is to provide an electrical contact for conducting current on the order of 1000 amperes or more through a minimum area.

A further object of the invention is to provide an electrical contact which distributes current over substantially the entire surface area of the mating connectors at the moment of contact, is easy to assemble, and wherein contact is improved with each assembly of the connectors.

Other objects, advantages and novel features of the invention will become apparent from the following detailed description thereof when considered in conjunction with the accompanying drawings in which like numerals represent like parts throughout and wherein.

The present invention concerns, in general, an electrical contact or connector having high current capability and in which full engagement of mating components is achieved at substantially the moment of contact between them. The contact includes a split, internally tapered circular sleeve that is spring loaded within a female socket. Compression of the spring during mating of the components causes a wedging action between a tapered pin, the split sleeve and the receptacle socket, resulting in considerable contact pressure between the segments of the split sleeve, the inner bore of the female receptacle and the tapered pin. The compression spring can be varied to accommodate the amount of connector travel available and to obtain the desired contact pressure. Slight dimensional discrepancies between the mating tapered components and cylindrical surfaces are dispersed by minute deformation of a soft silver plating on these surfaces.

Figure 1:
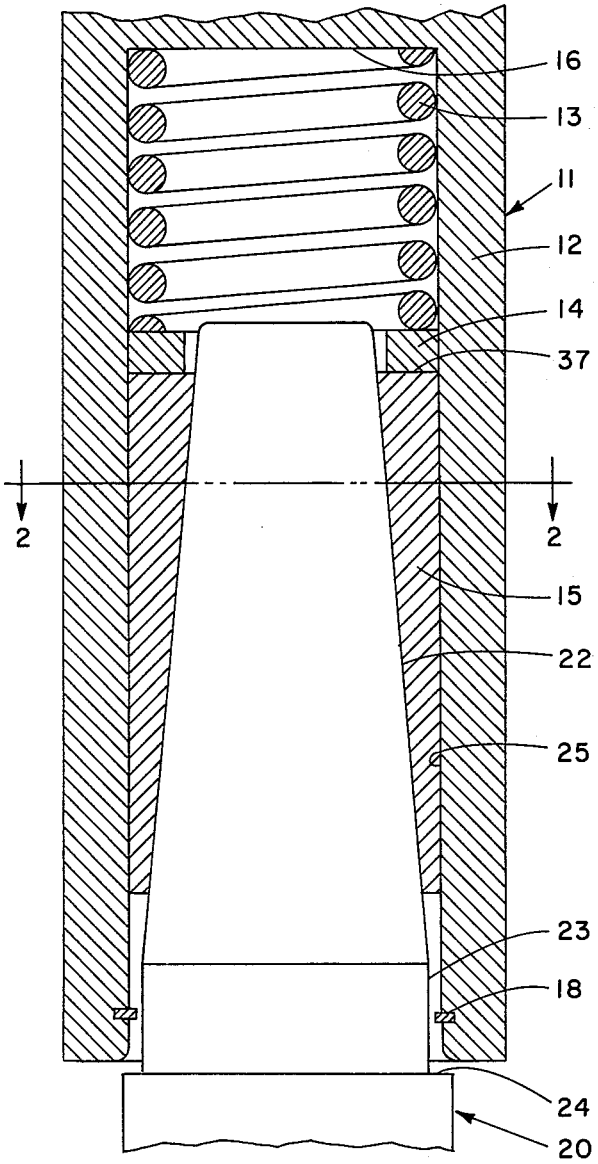
FIG. 1 is a front elevation partly in section of the assembled pin and receptacle of one embodiment of the invention.

Referring to the drawings, FIG. 1 shows the preferred form of the invention and includes a receptacle 11 which comprises a socket member 12 which is adapted to receive a spring 13, a washer 14 and at least a pair of tapered split sleeves 15 in a cylindrical cavity therein indicated at 16. These components are prevented from leaving the cavity, when the tapered contact is withdrawn, by a retaining ring 18. Compression spring 13 normally has squared and ground ends to provide more even distribution of force to split sleeves 15. A contact pin 20 is the male component of the connector and is provided with a tapered engaging end 22 which is adapted to mate with split sleeves 15, a cylindrical shank 23 to permit entry into cavity 16, and an enlarged flange section 24 which has a minimum diameter which is greater than the internal diameter of cavity 16 as indicated at 25.

Figure 2:
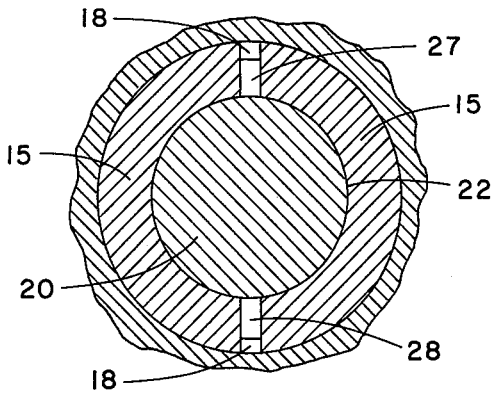
FIG. 2 is a cross section of the embodiment of FIG. 1 taken along a line substantially corresponding to line 2—2 in FIG. 1.

FIG. 2 is a cross section of the components of the embodiment of FIG. 1 in the operative condition and illustrates the intimate contact between the tapered surfaces 22 of pin 20 and split sleeves 15 a substantial distance from the narrow end of the contact pin. In this view, the split sleeves are shown to be two in number with the space between the longitudinal edges thereof indicated at 27 and 28. Retaining ring 18 is seen between these edges of the split sleeves.

Figure 3:
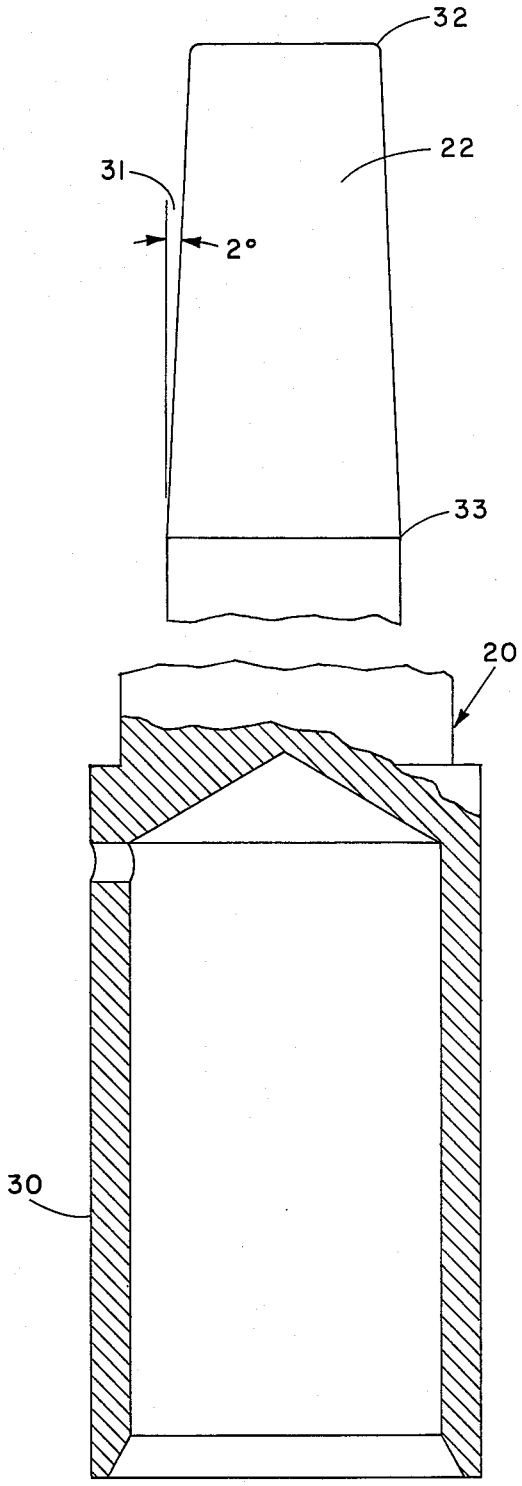
FIG. 3 is a front elevation partly in section of the contact pin of the embodiment of FIG. 1.

FIG. 3 shows in detail the construction of contact pin 20, which preferably is silver plated, the pin having a cylindrical extension 30 remote from tapered end 22 for engagement with conventional connecting means, not shown. End 22 is shown as having an external taper of 2° in this embodiment as indicated at 31. The tapered end has a reduced radius 32 to prevent damage to the silver plated surfaces of the split sleeves 15 during mating of the respective parts. The diameter of the contact pin at the widest portion of the taper, indicated at 33, is greater than the corresponding internal taper diameter of the split sleeves 15, thus insuring the desired wedging action at assembly.

Figure 9:
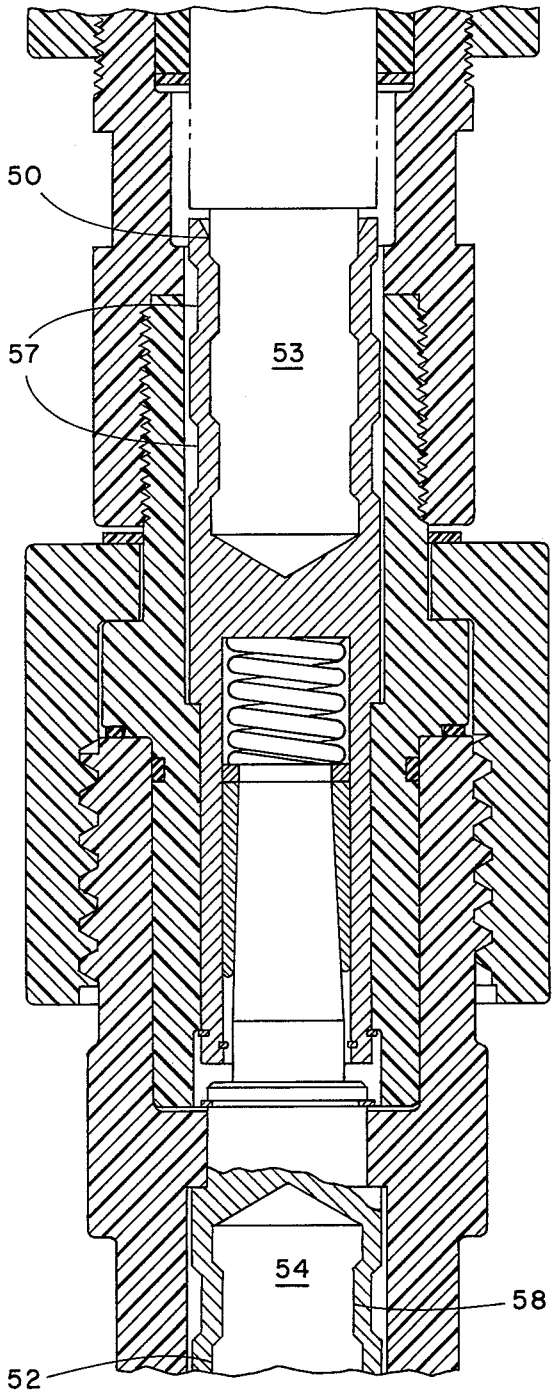
FIG. 9 is a front elevation partly in section of the embodiment of FIG. 1 installed in a shore line connection and ready for use.
Figure 5:
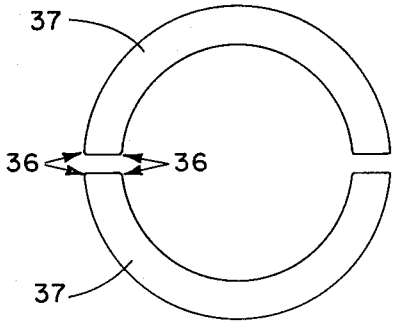
FIG. 5 is a plan view of the base of the split sleeve components in FIG. 4.
Figure 4:
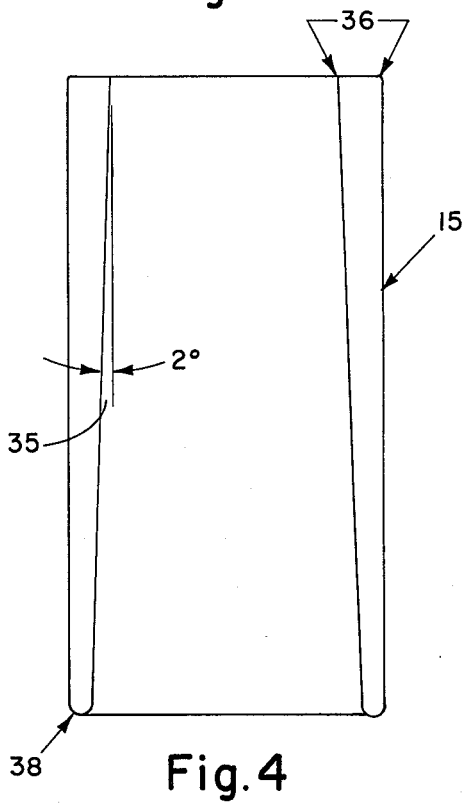
FIG. 4 is a front elevation of one of the split sleeve components of the receptacle in the embodiment of FIG. 1.
Figure 6:
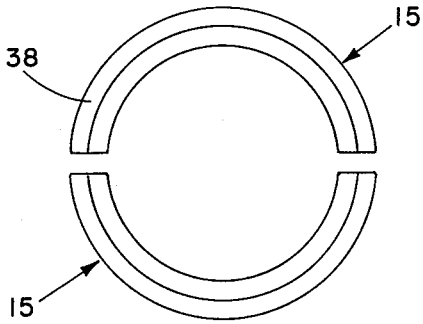
FIG. 6 is a bottom view of the split sleeve components in FIG. 4.
Figure 8:
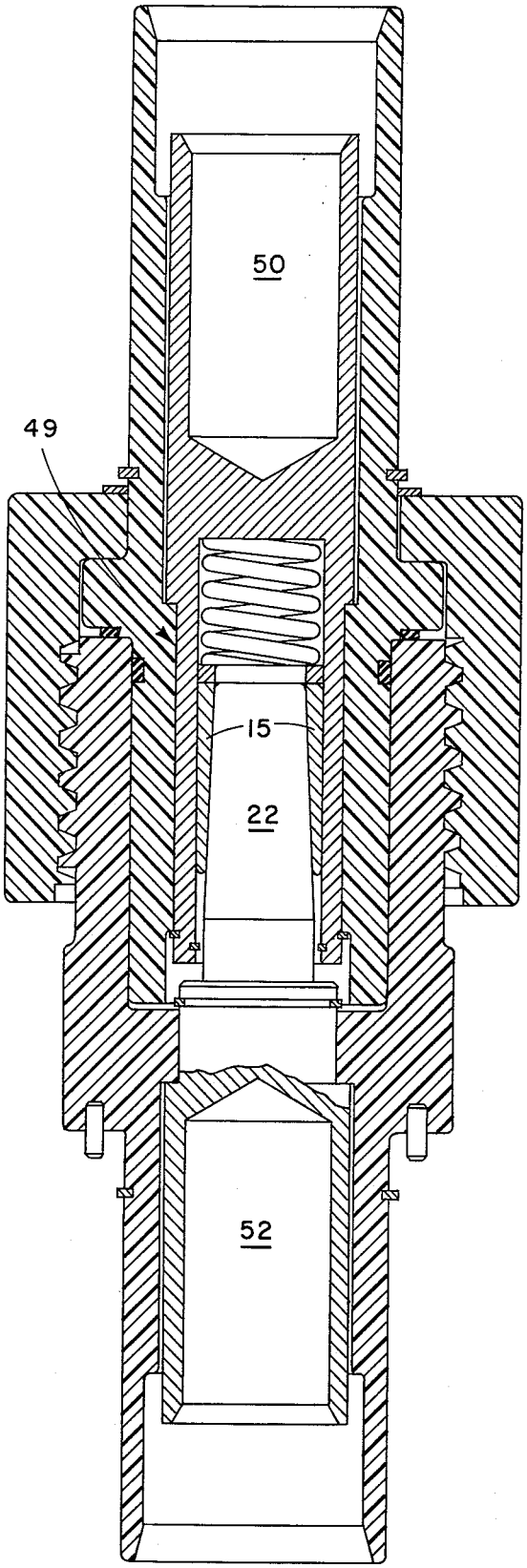
FIG. 8 is a front elevation partly in section of the embodiment of FIG. 1 installed in a shore power connection.
Figure 7:
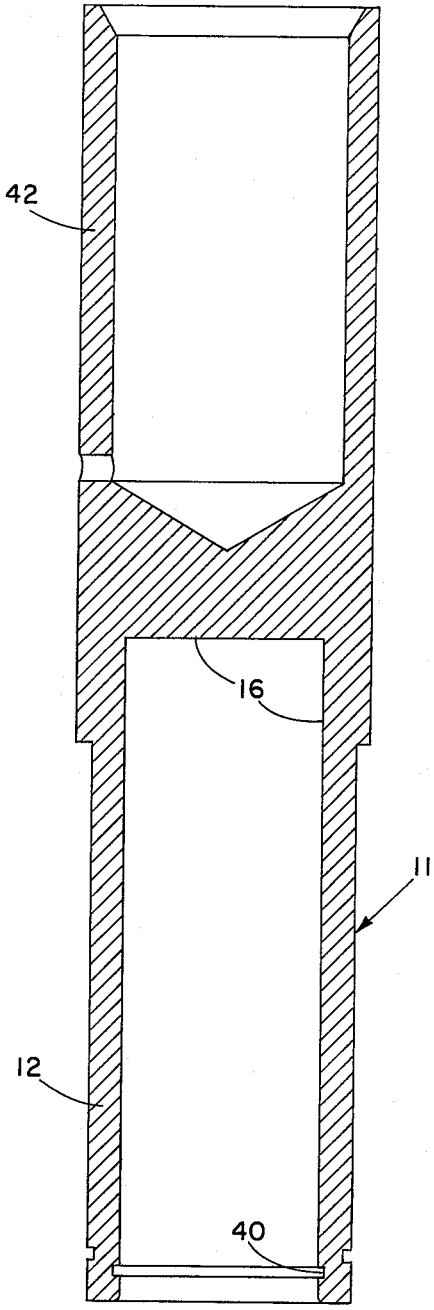
FIG. 7 is a full section of the socket of the embodiment of FIG. 1.

FIGS. 4–6 illustrate in greater detail the split sleeves of the invention, which also preferably are silver plated, with FIG. 4 showing a single sleeve 15 and indicating at 35 that the amount of taper of the internal surfaces is also 2° in this embodiment. All edges 36 of sleeves 15 have a slightly reduced radius to avoid scoring of the mating surfaces at assembly. FIG. 5 is an end view of the wider base surface of sleeves 15 which is indicated at 37, while FIG. 6 is a bottom view of the sleeves of the embodiment shown in FIG. 4 and illustrates the opposite end of split sleeves 15 which in this case are rounded at 38 to blend with the respective tapered and cylindrical surfaces in order to more readily accommodate the contact pin. FIG. 7 is a sectional view of the overall receptacle of the invention and includes end portion 12 having a preferably silver plated cavity 16 as shown in FIG. 1, an annular groove 40 for retention of the retaining ring 18, and a cylindrical end portion 42 for connection with conventional connectors. FIGS. 8 and 9 illustrate the embodiment of FIG. 1 installed in shore power lines for use in ship distribution systems when shipboard generating equipment is shut down. In FIG. 8, tapered pin end 22 is shown in mating contact throughout the length of respective split sleeves 15 within a receptacle 49 which has a cylindrical cavity 50 for connection to an external conductor, not shown. In this embodiment, the contact pin is provided with a cylindrical cavity 52 also for receiving an external conductor, not shown. In FIG. 9, cavities 50 and 52 of the embodiment of FIG. 8 are shown to have inserted therein conductors 53 and 54 respectively, with the side walls of the receptacle and contact pin cavities crimped as indicated at 57 and 58 in the usual manner. Although the embodiments in FIGS. 8 and 9 show the connector of the invention installed in shore power connector lines, it will be appreciated that other forms of external connection may be made within the teachings of the invention.

The split sleeve electrical contact of the invention is simple to assemble and provides a reliable, spring-loaded contact capable of high current conduction in a minimum of space. The combination of tapered, slidable split sleeves, a mating tapered contact pin, and spring loading within the female socket assure a considerable contact pressure which is constant and which is maintained constant because of the wedging action of the pin against the split sleeves and the cylindrical bore of the receptacle. Any minor dimensional discrepancies that may exist between the contacting surfaces are disposed of by applying the soft silver plating mentioned supra to the surface, i.e., the tapered pin, the internal and external surfaces of the split sleeves, and the cylindrical cavity of the receptacle. With such a soft lining, continual useage, i.e. mating of the pin sleeves and receptacle, will improve contact efficiency during use. The invention assures that no insertion force need be exerted until compression of a spring in the socket cavity commences, thus enabling the mechanical advantage of the coupling device to perform the mating. Large contact pressures thus are obtained solely by means of the coupling device since relatively short connector travel is required as compared with conventional slotted-type electrical contacts.

The invention permits in-place maintenance since all internal components are easily removed by first removing the retaining ring and, thereafter, are just as easily replaced. Any suitable metal of high conductivity may be used for the various components of the invention. However, oxygen-free copper is the preferred metal for all components except spring 13 and washer 14 for economy purposes mainly. Sleeve 15 may also be made of silver-copper alloy produced by power metallurgy techniques. The washer and spring are not intended to carry current and can be made of metal because of the additional strength provided by such materials. As previously indicated, one function of the compression spring is to obtain the desired balance between length of connector travel and contact pressure.

Obviously, many modifications and variations of the present invention are possible in the light of the above teachings. For example, the metal used in the various components may be replaced with alternate metals of comparable conductivity such as silver within the inventive concept or metals of lower conductivity such as brass or bronze alloys. Also, a greater number of sleeves may be employed than the two described and shown and, where necessary, the additional sleeves may be retained in a generally circular pattern by threading each end thereof with a circular wire spring.

What is claimed is:

1. An electrical connector having a high current carrying capacity, comprising in combination a receptacle having an open-ended cylindrical cavity formed therein;

a split sleeve slidably accommodated within said cylindrical cavity, said split sleeve consisting of two separate halves which have slightly less than semi-circular circumferences whereby said split sleeve normally fits loosely within said cylindrical cavity, said split sleeve having a wall thickness which decreases linearly from one end thereof to the other so as to provide said split sleeve with a tapered internal passageway therethrough and having a length which is less than the depth of said cylindrical cavity, the outer wall surface of said split sleeve and the inner wall surface of said cylindrical cavity having the same curvature;

means for biasing said split sleeve to a position within said cylindrical cavity whereat one end thereof is spaced by a predetermined amount from the end closure wall of said cavity; and a male member terminating in a truncated conical pin portion that has a taper which matches that of said internal passageway, a length of said pin portion being disposed within said split sleeve, said pin portion being dimensioned such that whenever said male member is inserted into said receptacle and moved to its operating position, both halves of said split sleeve are displaced axially toward the end closure wall of the cylindrical cavity and radially until the outer wall surface of said split sleeve meets the inner wall surface of said cylindrical cavity whereby contact is established between a length of the pin portion of said male member and the complete internal surface of said split sleeve and between a length portion of the inner wall surface of said cylindrical cavity and the complete external surface of said split sleeve.

2. In an electrical connector as defined in claim 1 wherein said means for biasing said split sleeve to a position within said cylindrical cavity includes a coil spring having one end thereof in contact with the end closure wall of said cylindrical cavity; and a washer, one inner rim surface of said washer being in contact with the other end of said coil spring and the other inner rim surface of said washer being in contact with said one end of said split sleeve, the opening in said washer being of sufficient size to permit the end of the pin portion of said male member to enter said washer without making contact therewith.

3. In an electrical connector as defined in claim 2 wherein said means for biasing said split sleeve to a position within said cylindrical cavity further includes a retaining ring mounted in the inner wall surface of said cavity adjacent the open end thereof, said ring having an inner diameter which is less than the outer diameter of said split sleeve, said coil spring normally maintaining the other end of said split sleeve up against the inner rim surface of said retaining ring.

4. In an electrical connector as defined in claim 1 wherein the pin portion of said male member has a length which is greater than that of said split sleeve.

5. In a connector as defined in claim 1 wherein said male member has a first cylindrical body portion from which said pin portion extends and a second cylindrical body portion from which said first cylindrical body portion extends.

the diameter of said first cylindrical body portion being less than the internal diameter of said cylindrical cavity and the diameter of said second cylindrical body portion being greater than the internal diameter of said cylindrical cavity whereby whenever said male member is in its operating position, the collar resulting from the different diameters of these body portions is up against the rim surface of the cylindrical cavity of the receptacle.

6. In an electrical connector as defined in claim 5 wherein the lengths of said pin portion and said first cylindrical body portion are such that when said male member is in its operating position, the end of said pin portion is outside of said split sleeve.

7. In an electrical connector as defined in claim 1 wherein the taper of said internal passageway and the taper of the pin portion of said male member is substantially 2°.

8. In an assembly as defined in claim 7 wherein said means for biasing said split sleeve to a position within said cylindrical cavity includes a coil spring having one end thereof in contact with the end closure wall of said cylindrical cavity;

a washer disposed between the other end of said coil spring and said one end of said split sleeve; and a retaining ring mounted in the inner wall surface of said cylindrical cavity at a location adjacent the open end thereof, said retaining ring having an inner diameter which is less than the outer diameter of said split sleeve.

9. An electrical connector for carrying high currents comprising in combination a receptacle formed with an open-ended cylindrical cavity which is closed off by an end wall;

a split sleeve, said split sleeve consisting of two similar members each of which has a slightly less than semi-circular circumference and each of which has a wall thickness that decreases linearly from one end to the other end thereof, whereby the split sleeve formed by said members has a tapered internal passageway, the external diameter of each member and the internal diameter of said cylindrical cavity being equal;

means for biasing said split sleeve to a position within said cylindrical cavity at which that end thereof which has the smaller opening therein confronts the end wall of said cavity and is spaced a predetermined distance therefrom, said receptacle, said split sleeve and said biasing means comprising the female unit of the electrical connector;

a male member terminating at one end thereof in a pin portion that has a taper which matches that of said internal passageway, a length of said pin portion being disposed within said split sleeve, said pin portion having dimensions such that whenever said male member is introduced into said receptacle and said pin portion moved inwardly to its operating position, the complete inner and outer wall surfaces of both members of said sleeve make contact with a length portion of the conical surface of the pin portion of said male member and a length portion of the cylindrical wall surface of said cavity, respectively, whereby extremely high currents can flow from said male member to said receptacle throughout the complete length of said split sleeve.

* * * * *